US005398104A

United States Patent [19]

Arcaro

[11] Patent Number: 5,398,104

[45] Date of Patent: Mar. 14, 1995

[54] PASSIVE TONER CONCENTRATION CONTROL SYSTEM

[75] Inventor: David J. Arcaro, Boise, Id.

[73] Assignee: Hewlett-Packard Company, Palo Alto, Calif.

[21] Appl. No.: 250,732

[22] Filed: May 27, 1994

[51] Int. Cl.[6] ..... G03G 21/00

[52] U.S. Cl. ..... 355/246; 141/65; 222/DIG. 1; 222/464; 355/256; 355/260; 417/61

[58] Field of Search ..... 355/256, 260, 246, 245; 222/DIG. 1, 376, 382, 464; 141/65; 137/173, 4, 88, 101.27, 393, 398, 404; 417/61

[56] References Cited

U.S. PATENT DOCUMENTS 3,631,880 1/1972 Hansel ..... 137/172

*Primary Examiner*—A. T. Grimley

*Assistant Examiner*—Nestor R. Ramirez

*Attorney, Agent, or Firm*—Anthony J. Baca

[57] ABSTRACT

In an electrophotographic printer, an apparatus for supplying a liquid toner that has a solids concentration within a predefined range. A concentrated solids material and a carrier liquid is contained within a reservoir. The concentrated solids has a solids concentration higher than the predefined range and has settled out from the carrier liquid. A tube has its orifice submerged in the concentrated solids material A second tube has its orifice submerged in the carrier liquid. To insure that the second tube remains above the concentrated solids material and simultaneously below the upper surface, a float is formed around the tube. Finally, a mixer is connected to the two tubes and mixes the concentrated solids with carrier liquid to create the liquid toner. The solids concentration range is directly related to the rations of the two orifices.

9 Claims, 3 Drawing Sheets

PASSIVE TONER CONCENTRATION CONTROL SYSTEM

TECHNICAL FIELD

The present invention relates to a passive system for supplying liquid toner to an electrophotographic printer.

BACKGROUND OF THE INVENTION

Electrophotographic printing is well known and has been widely refined. Using electrophotographic techniques, images are photoelectrically formed on a photoconductive layer mounted on a conductive base. Liquid or dry developer or toner mixtures may be used to develop a requisite image.

Liquid toner dispersions for use in the process are formed by dispersing dyes or pigments in natural or synthetic resin materials in a highly insulating high dielectric constant carrier liquid. Charge control agents are added to the liquid toner dispersions to aid in charging the pigment and dye particles to the requisite polarity for proper image formation on the desired substrate.

The photoconductive layer is sensitized by electrically charging whereby electrical charges are uniformly distributed over the surface. The photoconductive layer is then exposed by projecting or alternatively by writing an image over the surface with a laser, LED, or the like. The electrical charges on the photoconductive layer are conducted away from the areas exposed to the light with an electrostatic charge remaining in the imaged area. The charged pigment and or dye particles from the liquid toner dispersion contact and adhere to the image area of the plate. The image is then transferred to the desired substrate such as a sheet or paper.

With liquid electrophotography (LEP), the image development process requires that the toner be delivered to the developer at relatively constant concentration. However, usage of toner solids and toner carrier fluid in an LEP process are independent of each other. Toner solid consumption is proportional to the print coverage on the page and the number of pages printed. Whereas, toner carrier consumption is independent of print coverage and only a function of the number of pages printed. These characteristics result in toner concentration decreasing for above average page coverage and increasing for below average page coverage. Additionally, toner solids will settle out from the toner carrier over time. Thus, a toner concentration control is required for LEP processes.

Several active concentration systems are known in the art. Such active control systems generally measure one or more physical properties of the toner thereby determining an effective concentration of solids and carrier fluid. From this information the control system then enables the appropriate pumps to bring the concentration back into design specification. Such an arrangement requires the appropriate sensors, a metering pump for toner solids, a metering pump for the carrier fluid, a working reservoir in which the carrier fluid and solids are mixed and some means to mix within the working reservoir.

When an active toner concentration control system is applied to a color LEP printer the aforementioned items must be increased by a factor of four making such an arrangement prohibitively complex and costly. Another disadvantage of the active concentration control system is the difficulty and expense in incorporating all the elements into a single consumable. Some of the elements may actually become a permanent part of the printer. Such elements might include the working reservoir, the sensors, and metering pumps. The primary drawback of this approach is that they may need to be cleaned during toner replacement or addition due to contamination and sludge formation.

SUMMARY OF THE INVENTION

In order to accomplish the present invention, there is provided an apparatus for supplying a liquid toner that has a solids concentration within a desired range. A concentrated solids material and a carrier liquid is contained within a reservoir. The concentrated solids has a solids concentration higher than the desired range and has settled out from the carrier liquid. A tube has its orifice submerged in the concentrated solids material A second tube has its orifice submerged in the carrier liquid. To insure that the second tube remains above the concentrated solids material and simultaneously below the upper surface, a float is formed around the tube. Finally a mixer is connected to the two tubes and mixes the concentrated solids with carrier liquid to create the liquid toner. The solids concentration range is directly related to the rations of the two orifices.

DETAILED DESCRIPTION OF THE PREFERRED EMBODIMENTS

The present invention takes advantage of the inherent tendency of an LEP toner to separate into its two basic components. The ideal toner should separate as quickly as possible without separating in a developer.

Figure 1:
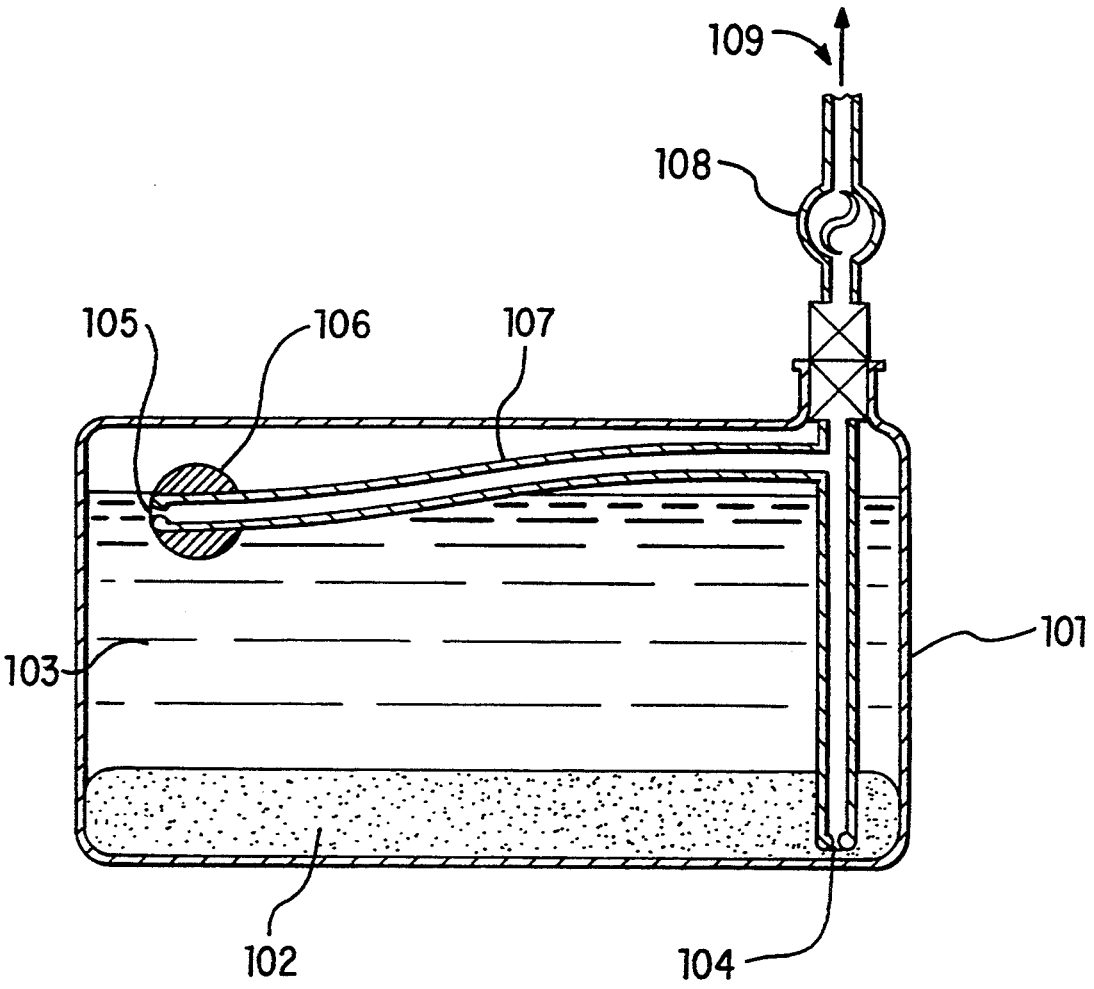
FIG. 1 shows a preferred embodiment in accordance with the present invention.

A preferred embodiment of the present invention is shown in FIG. 1. It consists of several elements which are primarily integrated into the toner cartridge 101. The toner mixture is housed by toner cartridge or reservoir 101 and is made up of toner concentrate 102 and toner carrier fluid 103. As stated earlier, it is the inherent tendency of an LEP toner to separate into these two basic components. When toner is required by the LEP printer, concentrate 102 is retrieved through orifice 104. In a similar manner, toner carrier fluid 103 passes through orifice 105. Thus, by properly sizing orifices 104 and 105 the overall concentration of toner solid and carrier fluid can be maintained.

Figure 3:
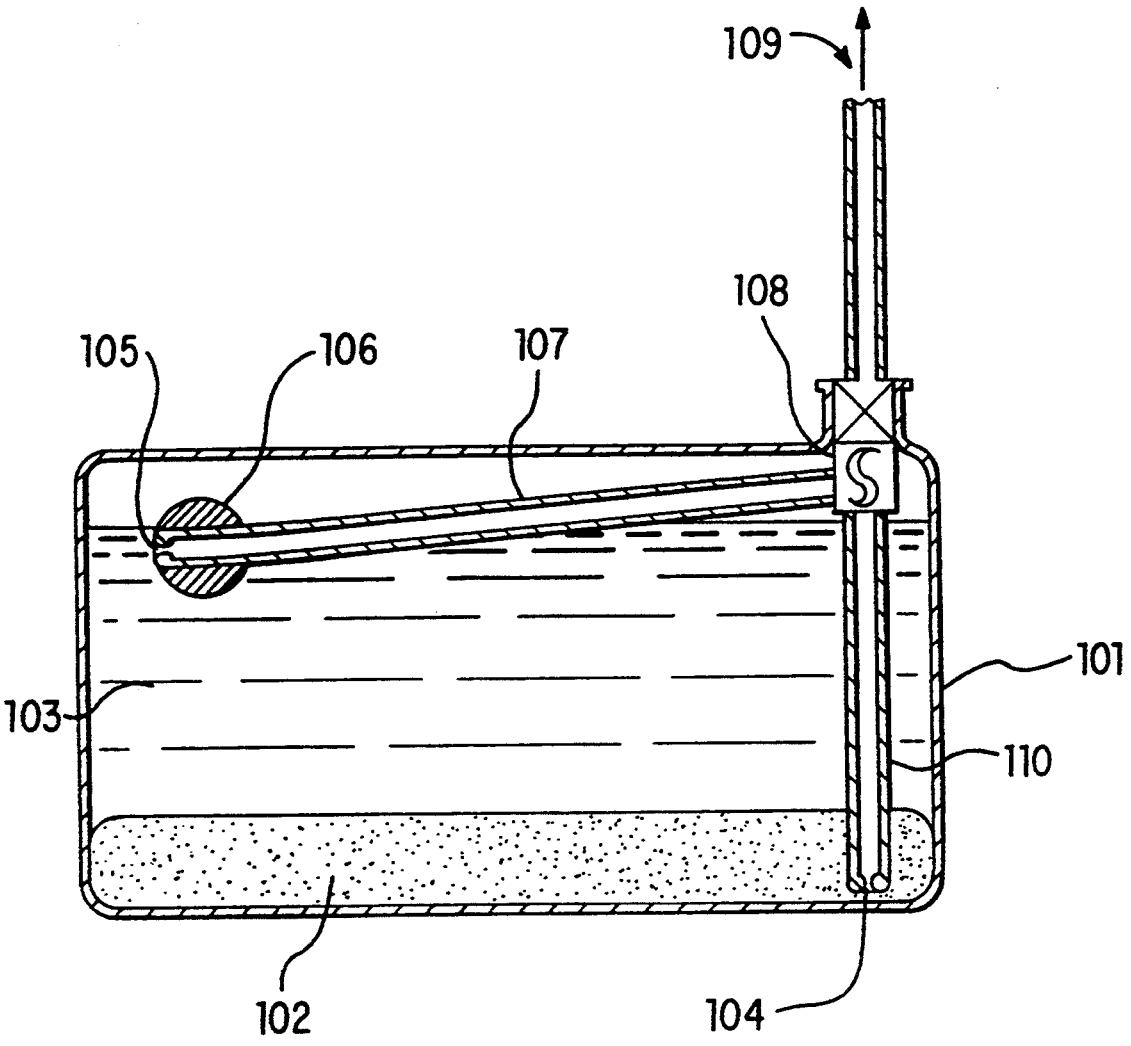
FIG. 3 shows an alternative embodiment in accordance with the present invention.

Carrier fluid tube 107 is made of a flexible material. Float 106 at the end of carrier fluid 107 ensures that carrier orifice 105 floats near the top of the toner carrier 103. As the overall level falls flexible carrier tube 107, with the aid of Float 106, ensures that carrier orifice 105 withdraws only toner carrier fluid 103. As the two fluids exit toner cartridge 101, they pass through inline mixer 108 thereby insuring proper mixture of the two components. An alternative embodiment as shown in FIG. 3 of the present invention replaces flexible tube 107 with a hinge and rigid tube. FIG. 3 also shows that Carrier fluid tube 107 and toner concentrate tube 110 can join directly to the mixer 108.

Figure 2:
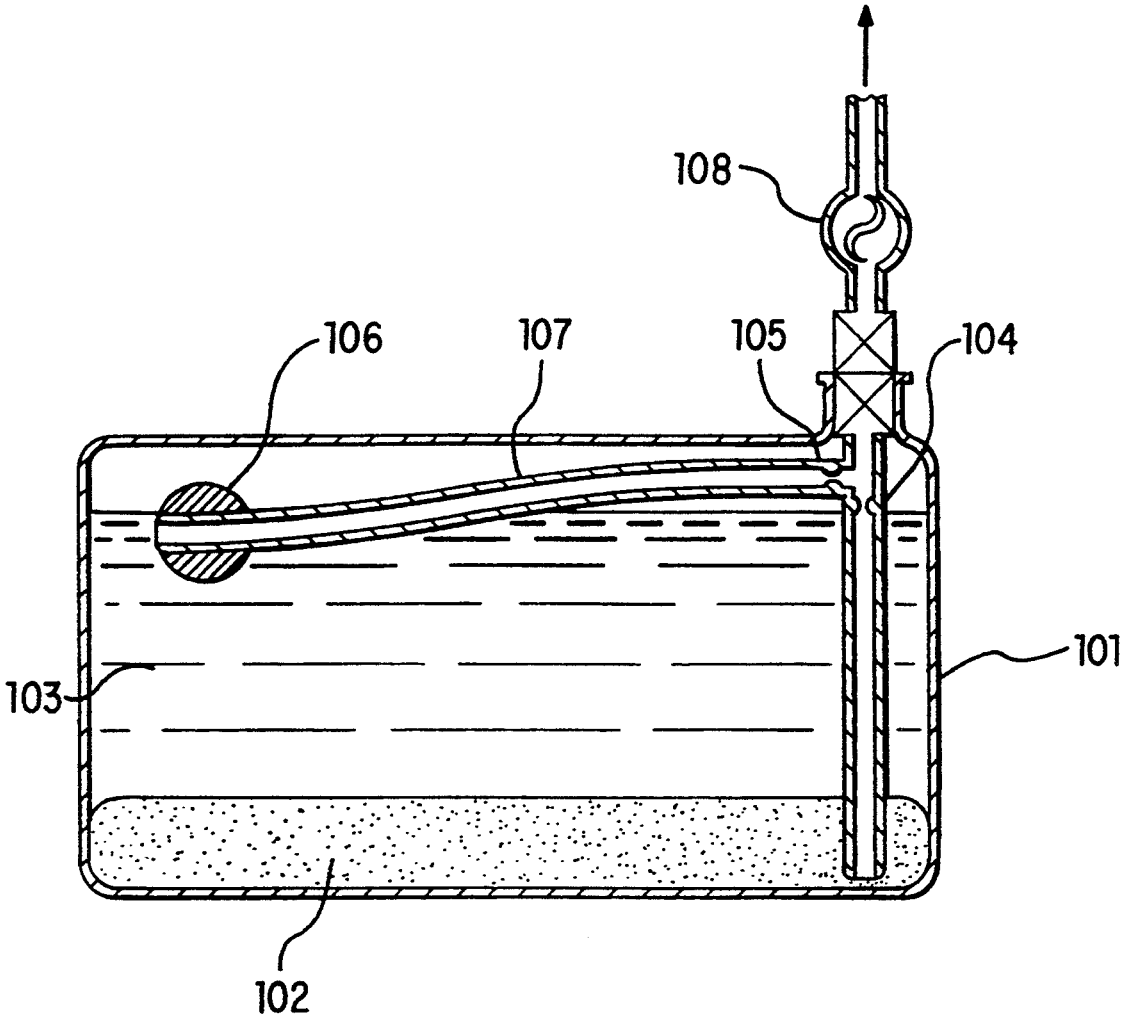
FIG. 2 indicates that the orifices can be placed anywhere along the length of the tube.

Briefly referring to FIG. 2 which shows another embodiment of the present invention. The embodiment of FIG. 2 conveys the understanding that orifices 104 and 105 may reside anywhere along the length of their respective tubes.

By creating a relatively large pressure drop at the orifices this system can be made insensitive to static head differences of fluid level and will deliver a constant ratio regardless of the relative quantities of concentrate and carrier. When either the concentrate 102 or carrier 103 is fully consumed the toner concentration is immediately and drastically altered providing a very obvious feedback to the user that it is time to replace toner cartridge 101.

With the passive toner concentration control system there is no need to measure the concentration. Concentration is maintained by properly sizing orifices 104 and 105. Additionally, there are no electronic control systems or sensors, thereby, reducing complexity and cost. Because of the relative simplicity of the overall design and low cost, all elements can be easily and cheaply integrated into a single consumable, namely, toner cartridge 101. An additional benefit of the passive toner concentration control system is that inline mixer 108 alleviates the need for any additional toner agitation. Finally the passive toner concentration control system operates regardless of the relative volumes of concentration and carrier remaining in the cartridge. Therefore, print quality will remain constant until either the concentration or carrier is depleted.

Although the preferred embodiment of the invention has been illustrated, and that form described, it is readily apparent to those skilled in the art that various modifications may be made therein without departing from the spirit of the invention or from the scope of the appended claims.

What is claimed is:

1. In a liquid electrophotographic printer, an apparatus for supplying a liquid toner concentrate, said liquid toner concentrate being comprised of toner solids and toner carrier, said apparatus comprising of:

toner cartridge that holds said toner solids and said toner carrier, said toner solids having a higher density than said toner carrier whereby said toner solids settle out from said toner carrier;

first tube having a first end and a second end, said first tube further having an orifice, said first end of said first tube being submerged in said toner solids;

second tube having a first end and a second end, said second tube further having an orifice, said first end of said second tube being submerged in said toner carrier, said first end further having a float attached whereby said float allows said first end of said second tube to extract only said toner carrier; and said second end of said first tube being connected to said second end of said second tube, said toner carrier and said toner solid being mixed together where said second end of said first tube connects to said second end of said second tube to create said liquid toner concentrate.

2. The apparatus as claimed in claim 1 wherein a ratio of said first orifice with said second orifice determines a ratio of said toner solids to said toner carrier.

3. The apparatus as claimed in claim 1 wherein said second tube is formed from a flexible material.

4. The apparatus as claimed in claim 1 wherein:

said second tube is formed from a rigid material; and said second end of said second tube further including a hinge that is connected to said second end of said first tube, said hinge being connected to said second end of said first tube.

5. The apparatus as claimed in claim 1 further including:

a mixer connected to said second end of said first tube and said second end of said second tube, said mixer mixes said toner solids and said toner carrier to create said liquid toner concentrate.

6. The apparatus as claimed in claim 1 wherein said first tube and said second tube being connected with a T shaped connector.

7. In a liquid electrophotographic printer, an apparatus for supplying a liquid toner having a solids concentration within a desired range, said apparatus comprising:

reservoir for holding a concentrated solids material and a carrier liquid, said concentrated solids having a solids concentration higher than said desired range, said concentrated solids having settled out from said carrier liquid, said carrier liquid having an upper surface;

a first tube having a first orifice, said first tube being submerged in said concentrated solids material;

a second tube having a second orifice, said second tube being submerged in said carrier liquid;

a float means for maintaining said second tube above said concentrated solids material and simultaneously maintaining said second tube below upper surface; and a mixer means connected to said first tube and said second tube, said mixer means mixes said concentrated solids from said first tube with said carrier liquid from said second tube to create said liquid toner with said desired range, said solid concentration being related to a size ratio of said first orifice to said second orifice.

8. The apparatus as claimed in claim 7 wherein said second tube is formed from a flexible material.

9. The apparatus as claimed in claim 7 wherein:

said second tube is formed from a rigid material; and said second tube further including a hinge that is connected to said mixer means.

* * * * *